US009944076B2

(12) United States Patent
Kashimura

(10) Patent No.: US 9,944,076 B2
(45) Date of Patent: Apr. 17, 2018

(54) LIQUID DISCHARGE HEAD AND LIQUID DISCHARGE APPARATUS

(71) Applicant: SEIKO EPSON CORPORATION, Tokyo (JP)

(72) Inventor: Toru Kashimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/426,557

(22) Filed: Feb. 7, 2017

(65) Prior Publication Data

US 2017/0266969 A1 Sep. 21, 2017

(30) Foreign Application Priority Data

Mar. 15, 2016 (JP) ..... 2016-051103

(51) Int. Cl.
*B41J 2/14* (2006.01)
*B41J 2/045* (2006.01)

(52) U.S. Cl.
CPC ..... *B41J 2/14201* (2013.01); *B41J 2/04541* (2013.01); *B41J 2/04581* (2013.01); *B41J 2002/14491* (2013.01)

(58) Field of Classification Search
CPC ..... B41J 2/14201; B41J 2/04581; B41J 2/04541; B41J 2002/14491; B41J 2/14072
See application file for complete search history.

(56) References Cited

U.S. PATENT DOCUMENTS 6,497,477 B1 * 12/2002 Nakamura ..... B41J 2/14233 347/70
9,656,467 B2 * 5/2017 Kakiuchi ..... B41J 2/14201
2005/0285903 A1 * 12/2005 Murata ..... B41J 2/14233 347/58
2006/0071959 A1 * 4/2006 Ito ..... B41J 2/14209 347/9
2008/0180490 A1 * 7/2008 Murata ..... B41J 2/14233 347/70
2008/0211883 A1 * 9/2008 Yamashita ..... B41J 2/14209 347/72
2009/0109264 A1 * 4/2009 Kubo ..... B41J 2/14209 347/71
2009/0244186 A1 * 10/2009 Ito ..... B41J 2/055 347/50

(Continued)

FOREIGN PATENT DOCUMENTS

JP 2014-051008 A 3/2014

*Primary Examiner* — Patrick King

(57) ABSTRACT

A liquid discharge head includes a piezoelectric element, a piezoelectric element-formed substrate, a drive IC, and a wiring board which has a first side and a second side intersecting each other. The wiring board has two surfaces including a first surface facing the drive IC and a second surface facing the piezoelectric element-formed substrate. The wiring board includes, on the first surface, a first input terminal for a drive signal to the piezoelectric element, a second input terminal for a control signal, a first wire connected to the first input terminal, and a second wire connected to the second input terminal. The first wire has a first connection terminal. The second wire has a second connection terminal. A distance along the second side from the first side to the first connection terminal is longer than a distance along the second side from the first side to the second connection terminal.

13 Claims, 9 Drawing Sheets

(56) References Cited

U.S. PATENT DOCUMENTS

2010/0231627 A1* 9/2010 Kondo ..... B41J 2/14209
347/14
2015/0210075 A1* 7/2015 Nishikawa ..... B41J 2/1433
347/47

* cited by examiner

LIQUID DISCHARGE HEAD AND LIQUID DISCHARGE APPARATUS

CROSS-REFERENCE TO RELATED APPLICATIONS

This application claims priority to Japanese Patent Application No. 2016-051103 filed on Mar. 15, 2016. The entire disclosure of Japanese Patent Application No. 2016-051103 is hereby incorporated herein by reference.

BACKGROUND

Technical Field

The present invention relates to a liquid discharge head that discharges a liquid and to a liquid discharge apparatus that includes the liquid discharge head.

Related Art

A liquid discharge apparatus (e.g., an ink jet printer) includes a liquid discharge head that discharges a liquid by using piezoelectric elements. Such a liquid discharge head includes a piezoelectric element-formed substrate in which piezoelectric elements are formed in a stacked state in a plate member that constitutes a portion of pressure chambers provided in liquid flow paths that communicate with nozzles, and discharges the liquid from the nozzles by outputting drive signals to the piezoelectric elements formed in the piezoelectric element-formed substrate.

Examples of such liquid discharge heads include a liquid discharge head having a structure in which a drive IC that outputs drive signals input to the liquid discharge head based on control signals also input to the liquid discharge head is packaged directly on a piezoelectric element-formed substrate so as to reduce the size of the liquid discharge head. Japanese Patent Application Publication No. 2014-51008, for example, describes a liquid discharge head in which a drive IC (driver IC) is directly packaged on a piezoelectric element-formed substrate (vibration plate) by connecting a plurality of bumps provided on the piezoelectric elements formed in the piezoelectric element-formed substrate to connection terminals provided on the piezoelectric element-formed substrate in a state in which the drive IC covers the piezoelectric elements.

However, in the related-art liquid discharge head, wires (electric wiring) through which drive signals and control signals are transmitted are connected directly to the drive IC. Therefore, for example, in the case where the number of nozzles increases for a higher nozzle density, the number of wires that transmit necessary signals to the drive IC accordingly increases, so that the impedance of the wires with regard to the drive signals and the control signals increases. In this case, there is a problem that signals transmitted through wires may have distortion due to an increase of impedance, causing fluctuations in liquid discharge characteristics. Therefore, it is desired to reduce the impedance of the wires in the liquid discharge head.

Such a problem is substantially common to liquid discharge heads that receive input of drive signals to drive the piezoelectric elements and control signals to control the output of the drive signals to the piezoelectric elements and that discharge liquid as the piezoelectric elements are driven by the output drive signals and also to the liquid discharge apparatuses equipped with such liquid discharge heads.

SUMMARY

An advantage of some aspects of the invention is that a liquid discharge head capable of inhibiting the fluctuation in a liquid discharging characteristic attributed to the impedance of wires while restraining an increase in the size of the head and a liquid discharge apparatus including the liquid discharge head are provided.

Configurations that achieve the above advantage and advantageous effects of the configurations will be described below.

A liquid discharge head according to an aspect of the invention includes a piezoelectric element, a piezoelectric element-formed substrate in which the piezoelectric element is formed, a drive IC that is configured and arranged to output a drive signal to the piezoelectric element based on a control signal, and a wiring board which has a first side and a second side intersecting each other. The wiring board has two surfaces including a first surface facing the drive IC and the second surface facing the piezoelectric element-formed substrate. The liquid discharge head receives the drive signal to drive the piezoelectric element and the control signal to control output of the drive signal to the piezoelectric element, and discharges a liquid in response to the drive signal output to the piezoelectric element to drive the piezoelectric element. The first surface of the wiring board includes a first input terminal to which the drive signal is input and a second input terminal to which the control signal is input, and further includes a first wire electrically connected to the first input terminal and a second wire electrically connected to the second input terminal. The first wire and the second wire extend along the second side. The first wire has a first connection terminal electrically connected to the drive IC. The second wire has a second connection terminal electrically connected to the drive IC. A distance along the second side from the first side to the first connection terminal is longer than a distance along the second side from the first side to the second connection terminal.

According to the liquid discharge head, the area ratio of the first wire that transmits the drive signal to the substrate surface of the wiring board can be increased in the region that is farther apart from the first side of the wiring board in the direction along the second side than the second connection terminal. Therefore, the impedance of the first wire can be reduced while increase in the area of the wiring board is restrained. Hence, in the liquid discharge head, it is possible to inhibit fluctuations in the liquid discharge characteristic attributed to the impedance of a wire while restraining an increase in the size of the liquid discharge head.

In the liquid discharge head, on the wiring board, a length of the second wire from the second input terminal to the second connection terminal is shorter than a length of the first wire from the first input terminal to the first connection terminal.

According to the configuration, because, on the wiring board, the length of the wire through which the control signal is transmitted is made shorter than the length of the wire through which the drive signal is transmitted, the influence that the control signal has on the drive signal can be inhibited.

In the liquid discharge head, on the wiring board, the first input terminal and the second input terminal is closer to the first side than a region in which the first wire is formed and a region in which the second wire is formed, respectively, and the first input terminal and the second input terminal is formed along the first side.

According to the configuration, because an occupied portion of the substrate surface of the wiring board which is occupied by the first input terminal and the second input terminal can be formed in a region near the first side, a region in the substrate surface of the wiring board which is apart from the first side along the second side can be used as a wiring region for the first wire and the second wire.

In the liquid discharge head, on the wiring board, the first wire has a bent portion at a location that is farther from the first side along the second side than the second connection terminal formed on the second wire. The bent portion is bent so as to be farther apart from the second side. An output terminal of the drive signal output from the drive IC is formed between the bent portion and the second side.

According to the configuration, the bent portion of the first wire is provided to allow a region in the substrate surface of the wiring board which is near the second side to be used as a wiring region for the output terminal of the drive signal for the piezoelectric element.

In the liquid discharge head, the second side of the wiring board is longer than the first side.

According to the configuration, for example, in the case where the piezoelectric element-formed substrate is provided with a plurality of piezoelectric elements, a plurality of output terminals from which drive signals are output to the corresponding piezoelectric elements can be formed on the wiring board along the second side that is longer than the first side.

In the liquid discharge head, on the wiring board, the first wire has a plurality of the first connection terminals spaced apart from each other along the second side.

According to the configuration, because the first wire and the drive IC are electrically interconnected at a plurality of locations, the increase in impedance attributed to connection can be inhibited. Therefore, occurrence of fluctuations in the liquid discharge characteristic attributed to distortion of drive signals can be inhibited.

In the liquid discharge head, on the first surface of the wiring board, at least a portion of the first wire is an embedded wire that is embedded in the wiring board.

According to the configuration, since the first wire is at least partially embedded in the wiring board, the cross-sectional area of the wires can be increased without increasing the width of the wires. This makes it possible to reduce the resistance (impedance) of the wires and inhibit the fluctuations in the liquid discharge characteristic attributed to the impedance of the wires.

In the liquid discharge head, the embedded wire has an embedded portion made of a conductive material and embedded in the wiring board, and a surface layer portion that covers a first surface side of the embedded portion and that is made of a conductive material different from the conductive material of the embedded portion.

According to the configuration, the first wire can inhibit, at the embedded wire, the electrical characteristic of the wire from changing with changes in the environment. Furthermore, a break of the wire due to migration or the like can be inhibited. Therefore, a highly reliable liquid discharge head can be provided.

In the liquid discharge head, the wiring board includes on the first surface a third input terminal to which a constant-potential signal that is a constant electric potential is input and a third wire electrically connected to the third input terminal, and the third wire is formed in a region on the first surface between a region in which the first wire is formed and a region in which the second wire is formed.

According to the configuration, since the constant-potential signal transmitted through the third wire exists between the drive signal transmitted through the first wire and the control signal transmitted through the second wire, distortion of the signal due to mutual interference between the drive signal and the control signal can be inhibited by the constant electric potential.

In the liquid discharge head, on the first surface of the wiring board, an area of the region in which the third wire is formed is smaller than an area of the region in which the first wire is formed and larger than an area of the region in which the second wire is formed.

According to the configuration, because differences in impedance between the first wire, the second wire, and the third wire can be relatively adjusted, the impedances of the drive signal, the constant-potential signal, and the control signal can be optimized. Therefore, the fluctuations in electric potential between the wires attributed to the impedances of the wires are inhibited, so that liquid discharge characteristic differences of the individual piezoelectric elements can be reduced.

In the liquid discharge head, on the first surface of the wiring board, at least a portion of the third wire is an embedded wire that is embedded in the wiring board.

According to the configuration, since the third wire is at least partially embedded in the substrate, the cross-sectional area of the third wire can be increased without increasing the width of the wire. This makes it possible to reduce the resistance (impedance) of the wire and inhibit the fluctuations in liquid discharge characteristic attributed to the impedance of the wire.

In the liquid discharge head, the embedded wire has an embedded portion made of a conductive material and embedded in the wiring board, and a surface layer portion that covers a first surface side of the embedded portion and that is made of a conductive material different from the conductive material of the embedded portion.

According to the configuration, the third wire can inhibit, at the embedded wire, the electrical characteristic of the wire from changing with changes in the environment. Furthermore, a break of the wire due to migration or the like can be inhibited. Therefore, a highly reliable liquid discharge head can be provided.

In the liquid discharge head, the wiring board includes on the second surface a fourth wire electrically connected to the constant electric potential, and an area of a region in which the fourth wire is formed on the second surface is larger than an area of the regions in which the first wire, the second wire, and the third wire are formed on the first surface.

According to the configuration, on the wiring board, a solid electrode (solid pattern) of a stable electric potential is formed on the second surface opposite to the first surface, corresponding to the entire wiring region of the first wire, the second wire, and the third wire that are formed on the first surface. Therefore, fluctuations in the liquid discharge characteristic of the liquid discharge head can be inhibited by, for example, inhibiting the distortion of a drive signal caused by external noise.

A liquid discharge apparatus according another aspect of the invention includes a liquid discharge head that includes a piezoelectric element, receives a drive signal to drive the piezoelectric element and a control signal to control output of the drive signal to the piezoelectric element, and discharges a liquid in response to the drive signal being output to the piezoelectric element to drive the piezoelectric element. The liquid discharge apparatus further includes a signal supply unit that supplies the drive signal and the control signal to the liquid discharge head. The liquid discharge head further includes a piezoelectric element-formed substrate in which the piezoelectric element is formed, a drive IC configured and arranged to output the drive signal to the piezoelectric element based on the control signal, and a wiring board which has a first side and a second side intersecting each other. The wiring board has two surfaces including a first surface facing the drive IC and the second surface facing the piezoelectric element-formed substrate. The first surface of the wiring board includes a first input terminal to which the drive signal supplied from the signal supply unit is input and a second input terminal to which the control signal supplied from the signal supply unit is input, and further includes a first wire electrically connected to the first input terminal and a second wire electrically connected to the second input terminal. The first wire and the second wire extend along the second side. The first wire has a first connection terminal electrically connected to the drive IC. The second wire has a second connection terminal electrically connected to the drive IC. A distance along the second side from the first side to the first connection terminal is longer than a distance along the second side from the first side to the second connection terminal.

BRIEF DESCRIPTION OF THE DRAWINGS

Referring now to the attached drawings which form a part of this original disclosure.

DETAILED DESCRIPTION OF EXEMPLARY EMBODIMENTS

A liquid discharge apparatus according an embodiment of the invention will be described below with reference to the accompanying drawings.

Figure 1:
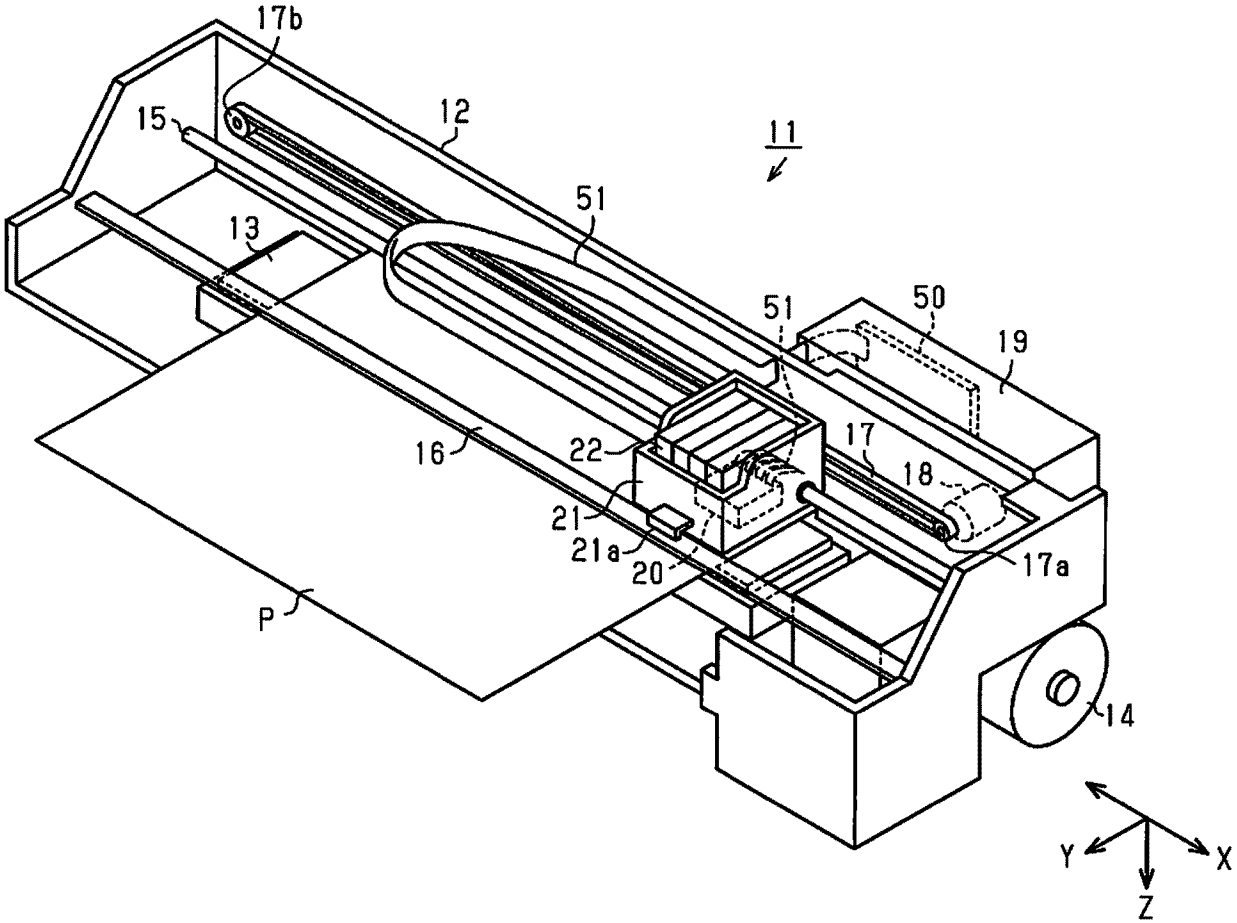
FIG. 1 is a perspective view schematically illustrating a configuration of a liquid discharge apparatus according to an embodiment of the invention.

As illustrated in FIG. 1, a liquid discharge apparatus 11 is an ink jet type printer that discharges ink, which is an example of liquid, from a head unit 20 to a sheet of paper P, which is an example of a medium, to perform printing (recording). In this embodiment, when the sheet P is subjected to printing, the sheet P is transported in one direction at a location that faces the head unit 20. The direction in which the sheet P is transported is termed the transport direction Y and a direction that intersects (preferably, is orthogonal to) the transport direction Y and that is along a width direction of the sheet P is termed the scanning direction X. That is, the scanning direction X and the transport direction Y in this embodiment are directions that intersect (preferably, are orthogonal to) each other and that both intersect a gravity direction Z that is a downward direction.

In the liquid discharge apparatus 11, a medium support table 13 extends, with its length lying in the scanning direction X, at a lower location inside a substantially rectangular box-shaped frame 12 and a sheet transporting motor 14 is provided at a lower portion of the frame 12. Due to the driving of the sheet transporting motor 14, a transporting mechanism (not illustrated in the drawings) transports the sheet P in the transport direction Y so that the sheet P passes over the medium support table 13.

Above the medium support table 13 inside the frame 12 there are a guide shaft 15 extending so as to have its axis lie in the scanning direction X, which is the longitudinal direction of the medium support table 13, and a guide plate 16 extending in the scanning direction X and having a narrow flat surface that has a predetermined width and that extends in the scanning direction X. There is provided a carriage 21 movable along the guide shaft 15 and the guide plate 16, more specifically, in the width direction of the sheet P transported over the medium support table 13, in other words, in the scanning direction X that intersects the transport direction Y.

More specifically, the guide shaft 15 is a solid or hollow cylindrical shaft that extends through a support hole that extends in the scanning direction X through a portion of the carriage 21 that is remote from a transport direction Y side of the carriage 21. The guide plate 16 is disposed so as to support, from below, a protruded portion 21*a* of the carriage 21 which is protruded in the transport direction Y. Therefore, the carriage 21 is supported and guided by the guide shaft 15 and the guide plate 16 and is movable back and forth along the scanning direction X over the print surface of the sheet of paper P.

A driving pulley 17*a* and a driven pulley 17*b* are each freely rotatably supported at locations on the frame 12 which are near two opposite ends of the guide shaft 15. The driving pulley 17*a* is connected to an output shaft of a carriage motor 18 and an endless timing belt 17 is wrapped around the driving pulley 17*a* and the driven pulley 17*b*. A portion of the timing belt 17 is connected to the carriage 21. Therefore, by driving the carriage motor 18, the carriage 21 is moved back and forth, via the timing belt 17, along the scanning direction X while being guided by the guide shaft 15 and the guide plate 16.

A head unit 20 that performs printing by discharging ink to the sheet P is attached to a gravity direction Z side of the carriage 21 that is movable back and forth. Furthermore, an ink cartridge 22 containing ink to be supplied to the head unit 20 is fitted to the carriage 21. In this embodiment, four ink cartridges 22 respectively containing four kinds of inks (e.g., four color inks of cyan, magenta, yellow, and black) that are fitted in the carriage 21.

In the liquid discharge apparatus 11, the frame 12 is provided with a housing portion 19 that houses a main board 50 that is a signal supply unit that supplies the head unit 20 with electrical signals for discharging ink from the head unit 20. The main board 50 housed in the housing portion 19 and the head unit 20 are electrically connected by a flexible printed circuit (FPC) 51 that is a flexible board that transmits electrical signals.

Figure 2:
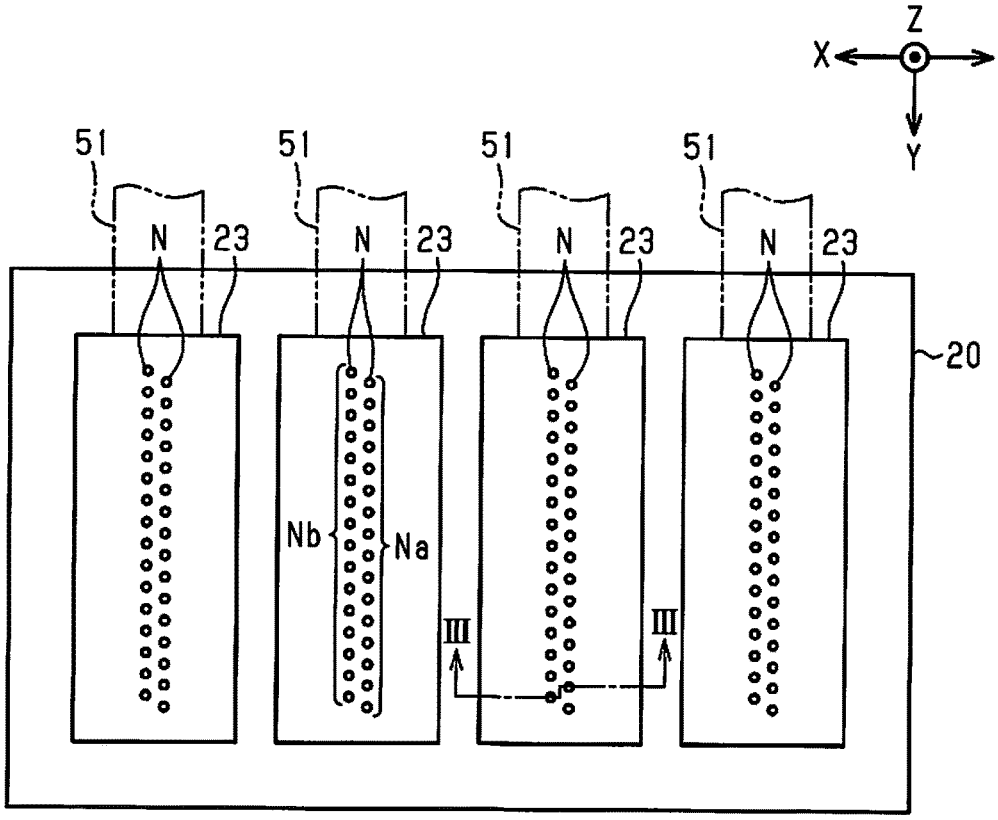
FIG. 2 is a plan view of a head unit mounted in the liquid discharge apparatus.

As illustrated in FIG. 2, the head unit 20 is provided with four head modules 23 arranged in the scanning direction X corresponding one-to-one to the four ink cartridges 22. Each head module 23 includes a plurality of nozzles N that discharge the ink and are aligned in the transport direction Y in rows (in this example, two rows that will be sometimes referred to as nozzle rows Na and Nb). In this embodiment, the four head modules 23 that discharge the inks have the same configuration and are supplied with electrical signals that correspond separately to the four head modules 23, via the FPC 51.

Next, a structure of a head module 23 will be described with reference to FIG. 3.

Figure 3:
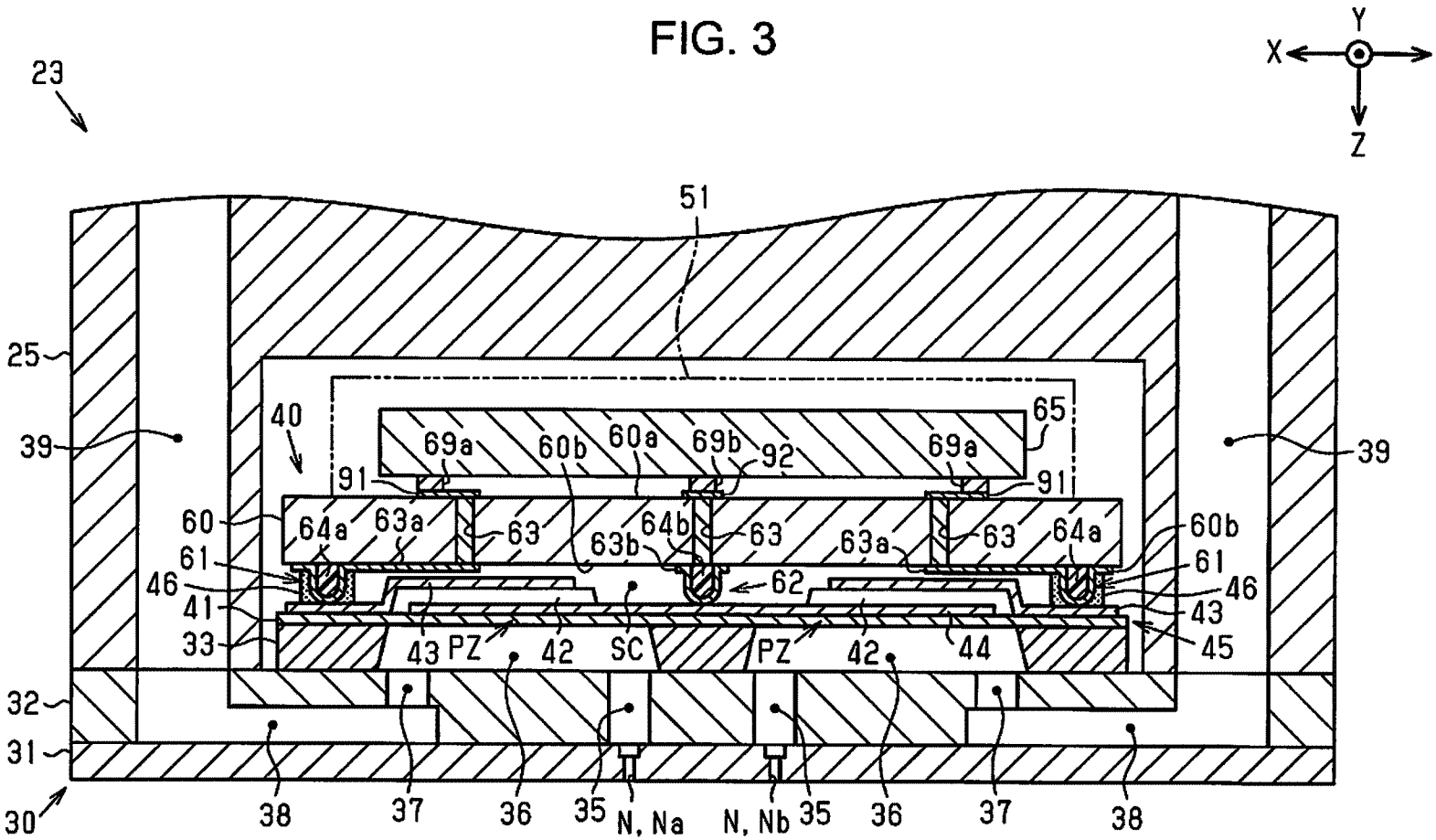
FIG. 3 is a sectional view taken along line III-Ill in FIG. 2, illustrating a configuration of head modules provided in a head unit.

As illustrated in FIG. 3, the head module 23 includes a flow path unit 30 that forms flow paths of ink and a liquid discharge head 40 that discharges ink from the nozzles N. The flow path unit 30 and the liquid discharge head 40 are stacked on each other and are mounted in a module case 25. Note that the stacking direction of the flow path unit 30 and the liquid discharge head 40 is an up-down direction along a vertical direction (gravity direction Z).

The flow path unit 30 includes a nozzle plate 31 provided with multiple nozzles N, a flow path substrate 32, a pressure chamber substrate 33, a vibrating substrate 41 in that order from below (from the gravity direction Z side). The flow path unit 30 is a structural body in which these components are stacked on and fixed to one another. The flow path unit 30 that is a structural body as described above is provided with nozzle communicating chambers 35 that communicate with the nozzles N, pressure chambers 36 that communicate with the nozzle communicating chambers 35, liquid supply paths 37 that communicate with the pressure chambers 36, and a common liquid chamber 38 that communicates with the liquid supply paths 37. Of these chambers and paths of the head module 23, the nozzle communicating chambers 35, the pressure chambers 36, and the liquid supply paths 37 are respectively formed corresponding one-to-one to the nozzles N while the common liquid chamber 38 connects to (communicates with) all the nozzles N of the head module 23 so that the nozzles N are supplied with the same ink.

The module case 25 is a substantially box-shaped member within which there is formed a liquid introducing path 39 that introduces ink from the ink cartridge 22 into the common liquid chamber 38 in the flow path unit 30. This liquid introducing path 39 is a space that, together with the common liquid chamber 38, stores the ink that is supplied to the pressure chambers 36 provided side by side in the flow path unit 30. In this embodiment, two liquid introducing paths 39 are formed corresponding to the two rows of the pressure chambers 36.

The liquid discharge head 40 is stacked on an upper side of the flow path unit 30. That is, the liquid discharge head 40 includes the vibrating substrate 41 provided with a piezoelectric element PZ, a wiring board 60, and a drive IC 65 that outputs a predetermined output voltage, in that order from below (from the gravity direction Z side). In other words, the liquid discharge head 40 is provided with the wiring board 60 of which a first surface 60*a* that is one of two opposite substrate surfaces faces the drive IC 65 and a second surface 60*b* that is the other substrate surface faces the vibrating substrate 41.

The vibrating substrate 41 is an elastically vibratable plate member and partially form the pressure chambers 36 of the flow path units 30. A substrate surface of the vibrating substrate 41 that is the opposite side thereof to the pressure chambers 36 is provided with a plurality of piezoelectric elements PZ that correspond one-to-one to the nozzles N. In detail, each piezoelectric element PZ includes a piezoelectric body 42 that drives (expands and contracts) when voltage is applied thereto, and also includes a first electrode 43 and a second electrode 44 disposed on opposite sides the piezoelectric body 42 in the up-down direction so that the piezoelectric body 42 is sandwiched therebetween. The first electrodes 43 formed on the piezoelectric bodies 42 are individual electrodes that correspond one-to-one to the pressure chambers 36 (i.e., to the nozzles N). The second electrode 44 is an electrode that is formed on a plate surface of the vibrating substrate 41 and that is common to the plurality of piezoelectric elements PZ formed corresponding to the plurality of pressure chambers 36 (i.e., to the plurality of nozzles N). When a voltage is applied between a first electrode 43 and the second electrode 44, the piezoelectric body 42 expands and contracts to vibrate (curve) the vibrating substrate 41, thus pressurizing the ink inside the pressure chamber 36 so that the ink is discharged from the nozzle N. The vibrating substrate 41 provided with the piezoelectric elements PZ will be referred to as piezoelectric element-formed substrate 45.

A wiring board 60 has on a first surface 60*a* thereof a plurality of first output terminals 91 and a plurality of second output terminals 92 that are electrically connected to the drive IC 65 and that receive voltages output from the drive IC 65. That is, the drive IC 65 is provided with an electric circuit for supplying the output voltages selectively to the plurality of piezoelectric elements PZ, and the like. The circuit-formed surface of the drive IC 65, that is, an active surface thereof, is provided with bumps 69*a* and bumps 69*b*. The drive IC 65 is electrically connected to the wiring board 60 by the bumps 69*a* electrically connected to the first output terminals 91 and by the bumps 69*b* electrically connected to the second output terminals 92. Thus, in the so-called flip chip packaging, the drive IC 65 is attached to the first surface 60*a* of the wiring board 60.

Furthermore, the wiring board 60 is provided with a plurality of penetrating wires 63 electrically connected separately to the first output terminals 91 and the second output terminals 92. The second surface 60*b* of the wiring board 60 is provided with connecting wires 63*a* and connecting wire 63*b* electrically connected separately to the penetrating wires 63. That is, the first output terminals 91 and the second output terminals 92 formed on the first surface 60*a* side of the wiring board 60 are electrically connected, via the penetrating wires 63 provided in the wiring board 60, to the connecting wires 63*a* and the connecting wire 63*b* provided on the second surface 60*b* side of the wiring board 60.

Furthermore, the second surface 60*b* of the wiring board 60 is provided with first conducting terminals 61 and second conducting terminals 62 electrically connected separately to the piezoelectric element-formed substrate 45. In this embodiment, each of the first conducting terminals 61 is a resin bump made up of an internal resin portion 64*a* and a connecting wire 63*a* covering the internal resin portion 64*a* and each of the second conducting terminals 62 is a resin bump made up of an internal resin portion 64*b* and a connecting wire 63*b* covering the internal resin portion 64*b*. Therefore, an output voltage from the drive IC 65 is transmitted to a first conducting terminal 61 provided on the second surface 60*b* side of the wiring board 60 and is also transmitted to a second conducting terminal 62 provided on the second surface 60*b* side of the wiring board 60. Then, the output voltage transmitted to the first conducting terminal 61 is supplied to a corresponding one of the first electrodes 43 in the piezoelectric element-formed substrate 45 and the output voltage transmitted to the second conducting terminal 62 is supplied to the second electrode 44 in the piezoelectric element-formed substrate 45, so that the ink is discharged from the corresponding nozzle N.

Furthermore, the first conducting terminals 61 and the second conducting terminals 62 form a gap having a predetermined size between the piezoelectric element-formed substrate 45 and the wiring board 60 facing the piezoelectric element-formed substrate 45 in the liquid discharge head 40. That is, the plurality of first conducting terminals 61 and the plurality of second conducting terminals 62 form, between the piezoelectric element-formed substrate 45 and the wiring board 60, a gap having such a size that the vibrating substrates 41 that are displaced in up-down directions do not contact the wiring board 60.

Incidentally, after the first conducting terminals 61 are connected between the piezoelectric element-formed substrate 45 and the wiring board 60, a space between the piezoelectric element-formed substrate 45 and the wiring board 60 which includes spaces between the connected first conducting terminals 61 may be filled with a sealer 46 made of a resin. As a result, a space surrounded by the piezoelectric element-formed substrate 45, the wiring board 60, the first conducting terminals 61 and the sealer 46 forms a sealing space SC that seals the piezoelectric elements PZ (see FIG. 4). In this sense, the wiring board 60 is also a sealing substrate that seals the piezoelectric elements PZ.

Figure 4:
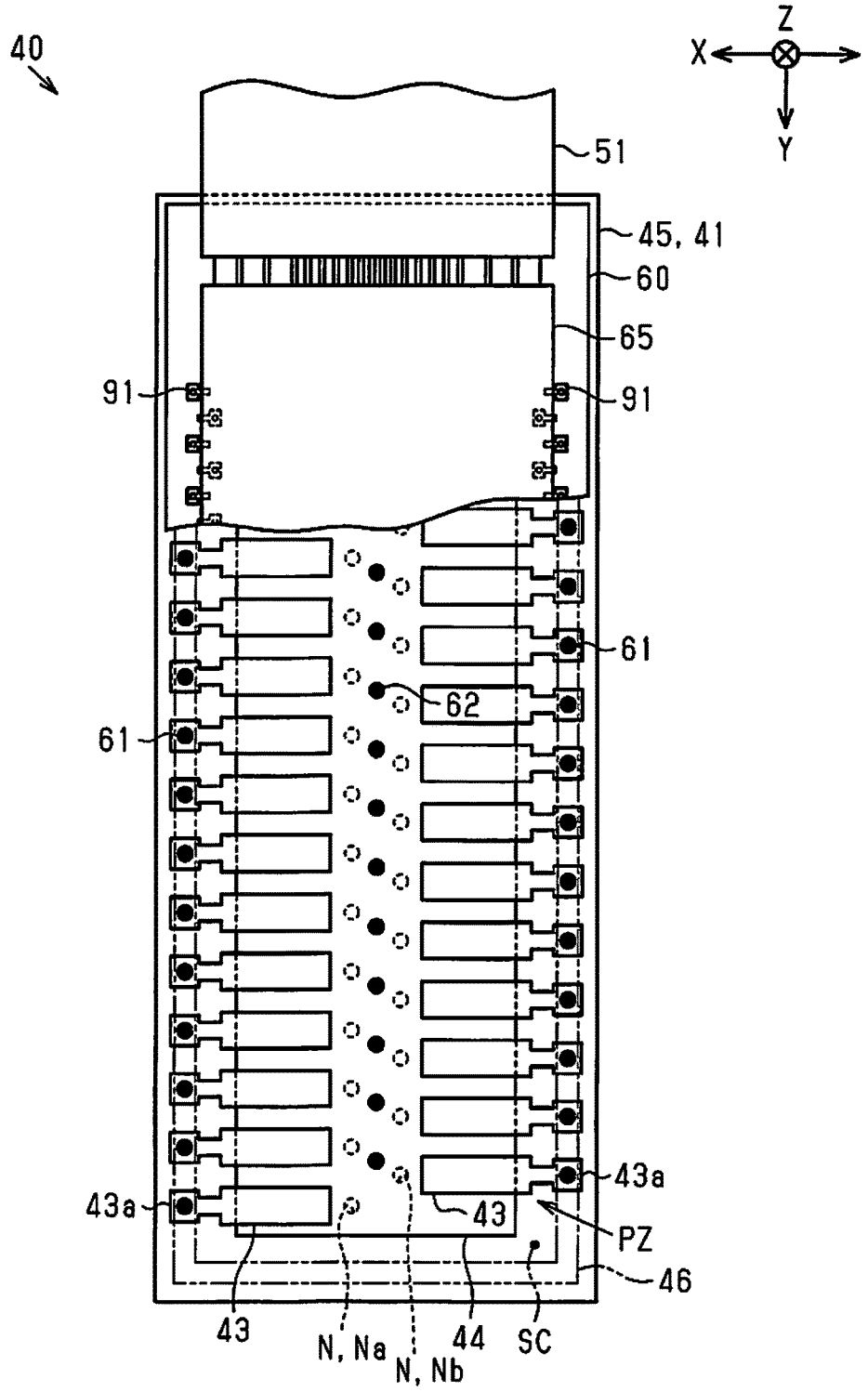
FIG. 4 is a plan view in which a wiring board and a drive IC are cut away to expose piezoelectric elements, illustrating a configuration of a liquid discharge head provided in a head module.

With reference to FIG. 4, a structure of the liquid discharge head 40 will be described. In FIG. 4, the piezoelectric bodies 42 are omitted from illustration.

As illustrated in FIG. 4, the first electrodes 43 are divided into two electrode groups that are a group of first electrodes 43 aligned on the piezoelectric element-formed substrate 45 in the transport direction Y so as to correspond to the nozzles N of the nozzle row Na and a group of first electrodes 43 aligned in the transport direction Y so as to correspond to the nozzles N of the nozzle row Nb.

Each first electrode 43 is provided with an extended electrode 43*a* having a rectangular electrode shape that is extended toward an outer perimeter of the piezoelectric element-formed substrate 45. The extended electrode 43*a* of each first electrode 43 is connected to a corresponding one of the first conducting terminals 61 that are provided side by side along the transport direction Y as indicated by solid circles in FIG. 4. Furthermore, the second conducting terminals 62 are provided side by side along the transport direction Y and connected to the second electrode 44 of the piezoelectric elements PZ as indicated by solid circles in FIG. 4.

In the liquid discharge head 40 of this embodiment, an electrical signal transmitted from the main board 50 via the FPC 51 is input to the wiring board 60 and, based on the input electrical signal, the drive IC 65 outputs a predetermined output voltage (drive voltage).

Figure 5:
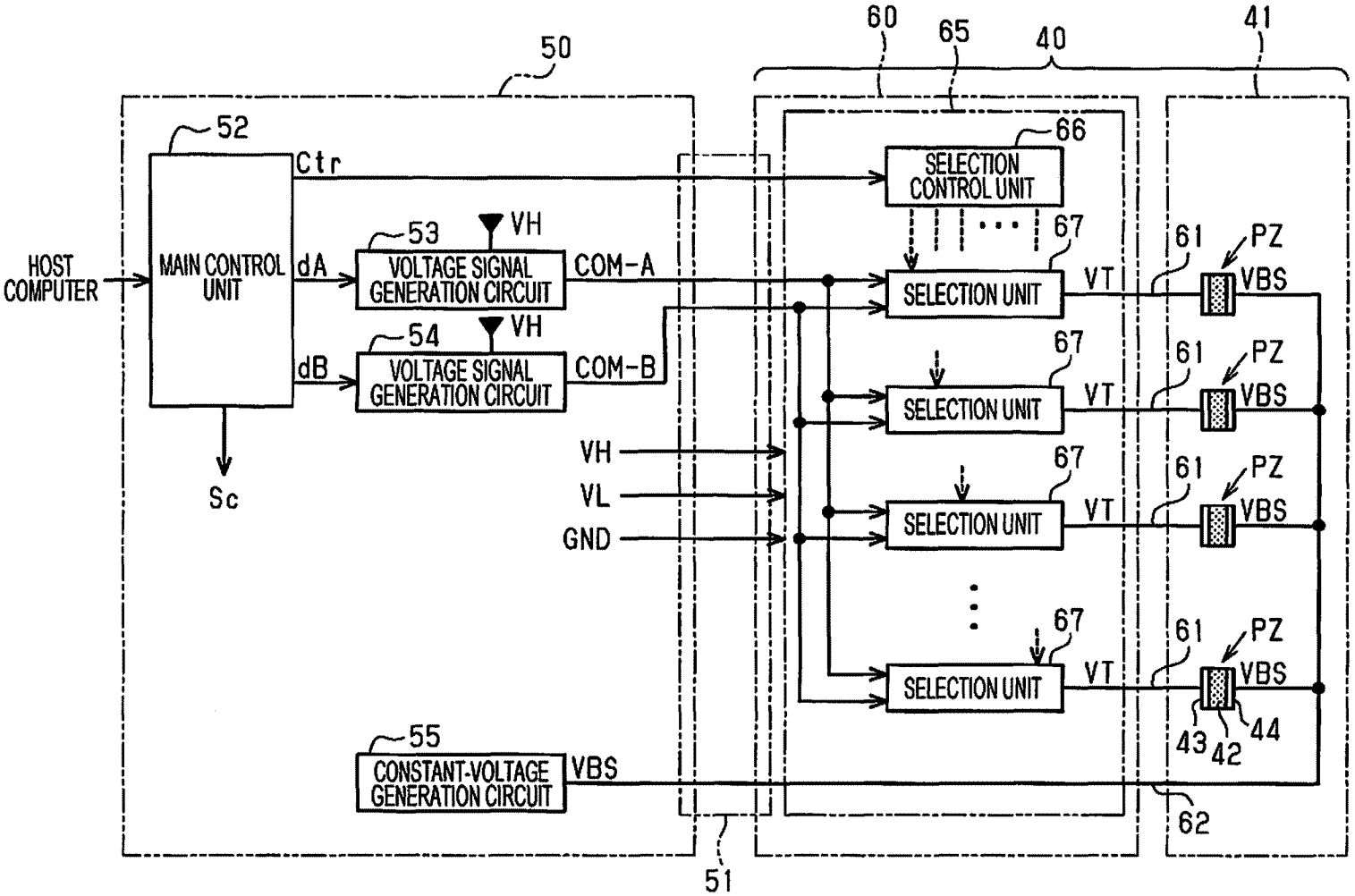
FIG. 5 is a circuit block diagram illustrating a circuit configuration in which drive signals for driving the piezoelectric elements are output to the piezoelectric elements.

With reference to FIG. 5, electrical signals transmitted from the main board 50 via the FPC 51 and output voltages output from the drive IC 65 will be described. In this embodiment, in the four head modules 23 arranged in the head unit 20, the generation of the electrical signals that are transmitted via the FPC 51 and the generation of output signals that are output to the piezoelectric elements PZ are carried out by substantially identical circuit arrangements. Therefore, one head module 23 will be described as a representative.

As illustrated in FIG. 5, the main board 50 is provided with a main control unit 52, two voltage signal generation circuits 53 and 54, and a constant-voltage generation circuit 55. The drive IC 65 of the liquid discharge head 40 has an electric circuit for outputting a drive voltage VT and a constant voltage VBS as output voltages to the first electrodes 43 and the second electrode 44, respectively, of the piezoelectric elements PZ.

The main control unit 52, when supplied with image data that are a print subject from a host computer or the like, outputs, among others, various control signals for controlling the voltage signal generation circuits 53 and 54 and electric circuits of the drive IC 65. Concretely, the main control unit 52 repeatedly supplies digital data dA to one voltage signal generation circuit 53 or 54 of the two voltage signal generation circuits 53 and 54 and repeatedly supplies digital data dB to the other voltage signal generation circuit 54. Note that the data dA define the signal waveform of a first voltage signal that is an electrical signal transmitted to the liquid discharge head 40 and the data dB define the signal waveform of a second voltage signal that is an electrical signal transmitted to the liquid discharge head 40.

The one voltage signal generation circuit 53 converts the data dA repeatedly supplied into an analog voltage, amplifies the analog voltage by, for example, class D amplification, to form an analog first voltage signal, and then outputs the first voltage signal as a drive signal COM-A to the liquid discharge head 40. Likewise, the other voltage signal generation circuit 54 converts the data dB repeatedly supplied into an analog voltage, amplifies the analog voltage by, for example, class D amplification, to form an analog second voltage signal, and then supplies the second voltage signal as a drive signal COM-B to the liquid discharge head 40. Incidentally, the two voltage signal generation circuits 53 and 54 are different only in the input data and the signal waveform of the output voltage signal and identical in circuit configuration, and use a constant voltage VH as electric power supply.

Furthermore, the main control unit 52 outputs a control signal Sc that controls the driving of the carriage motor 18 and the sheet transporting motor 14 so as to control the movement of the carriage 21 and the transport of the sheet P, and, synchronously with this control signal Sc, supplies various control signals Ctr as electrical signals to the liquid discharge head 40. Incidentally, each control signal Ctr supplied to the liquid discharge head 40 is a digital (binary voltage) voltage signal. In this embodiment, the control signals Ctr include print data that define the amount of ink to be discharged from a nozzle N, a clock signal for use for transfer of the print data, a timing signal that defines the print cycle or the like.

Furthermore, besides the drive signals COM-A and COM-B and the control signals Ctr, the main board 50 supplies via the FPC 51 a constant voltage VBS generated by the constant-voltage generation circuit 55. Furthermore, the voltage VH that is a constant electric potential as an electric power supply for operation of the electric circuits of the drive IC 65, a voltage VL that is a lower constant electric potential than the voltage VH, and a ground voltage GND (0 V) that is a constant electric potential that serves as a reference for the voltages are supplied via the FPC 51. In other words, the voltages VH and VL and the ground voltage GND (0 V) that are constant electric potentials are supplied as constant-potential signals via the FPC 51.

Figure 6:
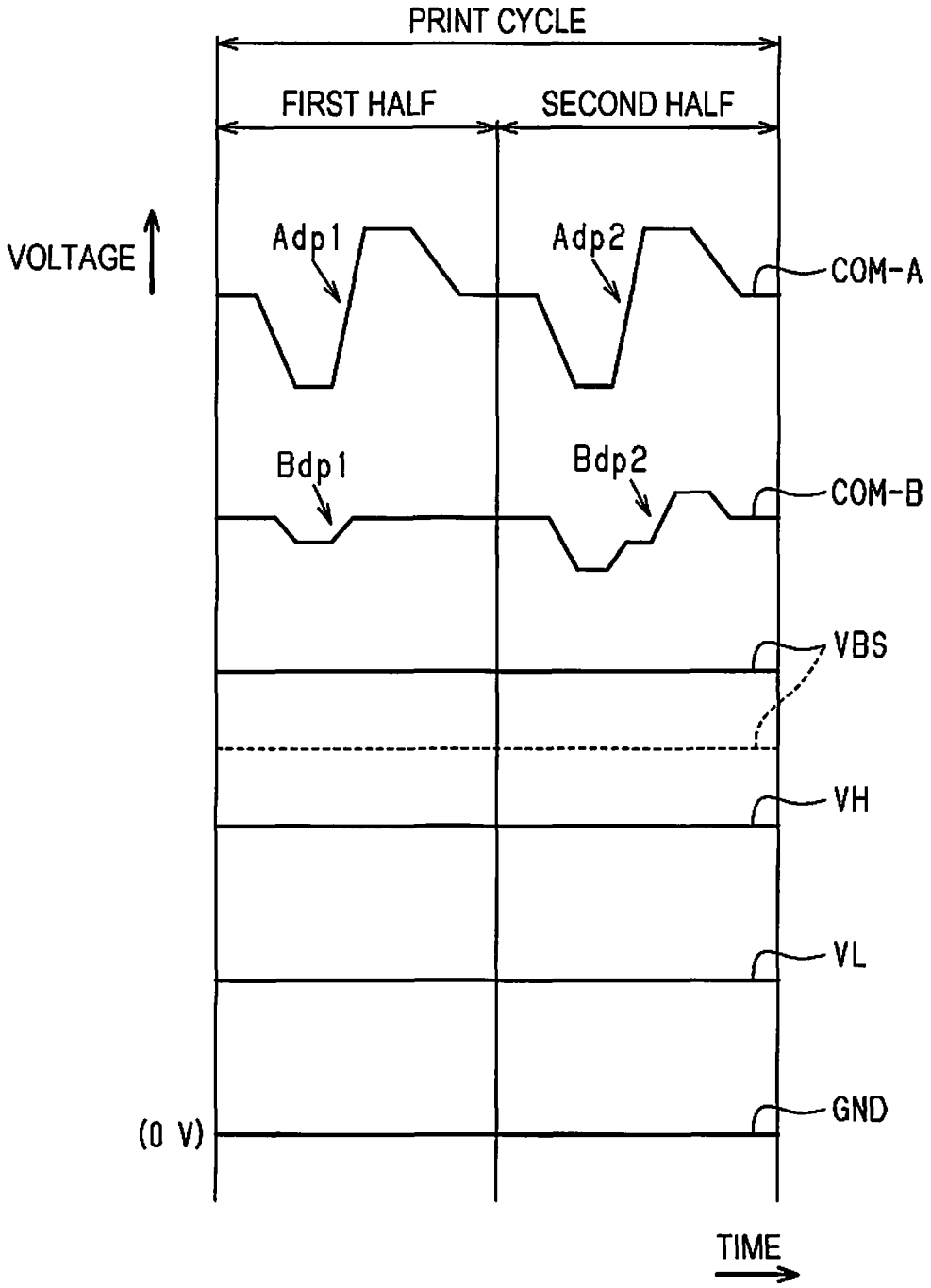
FIG. 6 is a waveform diagram illustrating signal waveforms of various voltage signals that are input to the wiring board.

As illustrated in FIG. 6, the drive signal COM-A in this embodiment has a signal waveform that continuously combines a trapezoidal waveform Adp1 provided in the first half period of a print cycle and a trapezoidal waveform Adp2 provided in the second half period. The trapezoidal waveform Adp1 and the trapezoidal waveform Adp2 are substantially identical waveforms. Either waveform is a voltage waveform that indicates a change in voltage that, when supplied to the first electrode 43 of a piezoelectric element PZ, causes the piezoelectric element PZ to discharge an intermediate amount of ink from the corresponding nozzle N.

Furthermore, the drive signal COM-B in this embodiment has a signal waveform that continuously combines a trapezoidal waveform Bdp1 provided in the first half period of the print cycle and a trapezoidal waveform Bdp2 provided in the second half period. The trapezoidal waveform Bdp1 and the trapezoidal waveform Bdp2 have mutually different waveforms. Of these two waveforms, the trapezoidal waveform Bdp1 is a waveform for preventing increased viscosity of ink by finely vibrating the ink in the vicinity of the nozzles N. Specifically, the trapezoidal waveform Bdp1 is a voltage waveform that indicates a change in voltage that, when applied to the first electrode 43 of a piezoelectric element PZ, does not cause the piezoelectric element PZ to discharge ink (ink droplet) from the corresponding nozzle N. Furthermore, the trapezoidal waveform Bdp2 is a voltage waveform that indicates a change in voltage that, when applied to the first electrode 43 of a piezoelectric element PZ, causes the piezoelectric element PZ to discharge from the correspond nozzle N a small amount of ink that is smaller than the intermediate amount of ink discharged when the trapezoidal waveform Adp1 or the trapezoidal waveform Adp2 is applied to the first electrode 43.

Other signals in the embodiment, that is, the constant voltage VBS, the voltage VH, the voltage VL, and the ground voltage GND, are each a constant voltage whose voltage value does not change or changes only very little during the print cycle. Incidentally, the constant voltage VBS may be generated in the constant-voltage generation circuit 55 so that the voltage value thereof may fluctuate during a single print cycle as a unit period, for example, as illustrated by an interrupted line in FIG. 6. Furthermore, the voltage VH or the voltage VL may be generated by the constant-voltage generation circuit 55.

Referring back to FIG. 5, the drive IC 65 provided in the liquid discharge head 40 includes a selection control unit 66 and selection units 67 that correspond one-to-one to the piezoelectric elements PZ as an electric circuit for supplying voltages selectively to the plurality of piezoelectric elements PZ. Specifically, the drive IC 65 selectively outputs the drive signal COM-A or the drive signal COM-B transmitted from the main board 50 via the FPC 51 to the first electrode 43 of a piezoelectric element PZ.

More specifically, the selection control unit 66 temporarily accumulates a clock signal transmitted from the main board 50 via the FPC 51 and print data transmitted from the main board 50 via the FPC 51 in synchronization with the clock signal in an amount corresponding to several nozzles N (piezoelectric elements PZ) of the head unit 20. Then, according to the accumulated print data, the selection control unit 66 instructs each of the selection units 67 to select either one of the drive signals COM-A and COM-B, at the starting time of a print cycle (the first half period and the second half period) stipulated by a timing signal transmitted from the main board 50 via the FPC 51. Each selection unit 67, according to the instruction from the selection control unit 66, selects one of the drive signals COM-A and COM-B (or does not select either one of them), and outputs the signal as a drive voltage VT to be applied to a corresponding one of the piezoelectric element PZ to the corresponding first electrode 43 via the first conducting terminals 61.

Furthermore, the drive IC 65 outputs a constant voltage for a piezoelectric element PZ to the second electrode 44. Specifically, in this embodiment, a constant voltage VBS transmitted from the main board 50 via the FPC 51 is input to the drive IC 65 via the wiring board 60. After that, the input constant voltage VBS is output from the drive IC 65, via the second conducting terminals 62 provided in the wiring board 60, to the second electrode 44 of the plurality of piezoelectric elements PZ of the liquid discharge head 40.

As the drive voltage VT is output from the drive IC 65 selectively to piezoelectric elements PZ, the output drive voltage VT applied to the first electrodes 43 of the piezoelectric elements PZ and the output constant voltage VBS is applied to the second electrode 44. As a result, the piezoelectric elements PZ undergo expansion and contraction commensurate with the difference voltage (potential difference) between the drive voltage VT and the constant voltage VBS, with ink discharged from the corresponding nozzles N due to the expansion and contraction. Then, according to the amounts of ink discharged, different sized dots are formed on the sheet P. Therefore, the constant voltage VBS can also be considered a drive signal.

Referring back to FIG. 3, the first surface 60*a* of the wiring board 60 is electrically connected to the FPC 51 and the drive IC 65. Specifically, the first surface 60*a* of the wiring board 60 is provided with input terminals to which the electrical signals transmitted via the FPC 51 are input and connection terminals that are electrically connected to the drive IC 65 so that the electrical signals input to the input terminals are transmitted to the drive IC 65.

Figure 7:
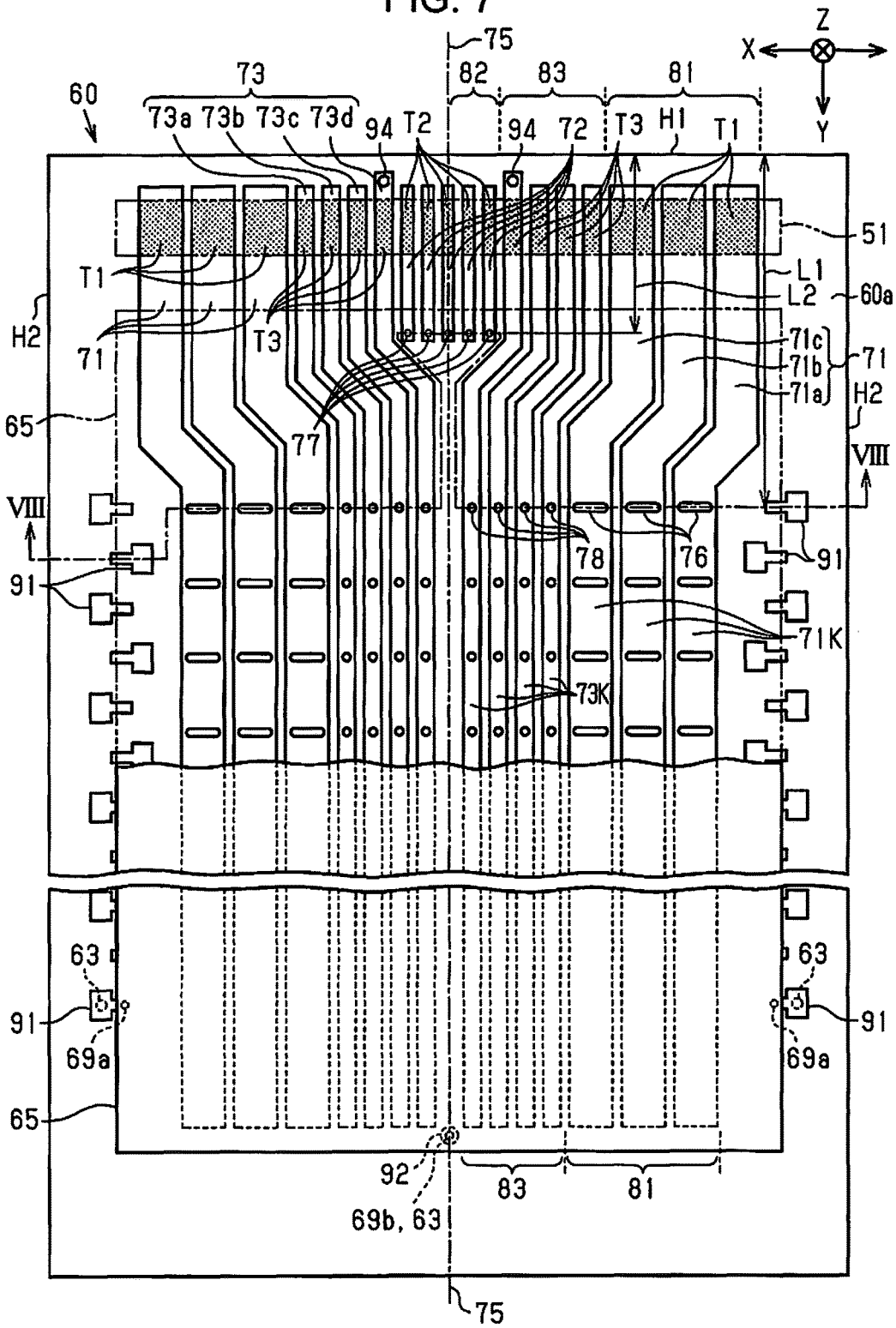
FIG. 7 is a plan view illustrating the drive IC in a partially cutaway view and the wiring board where wires that transmit voltage signals have been formed on a first surface that faces the drive IC.

With reference to FIG. 7, the input terminals and the connection terminals mentioned above will be described.

As illustrated in FIG. 7, the wiring board 60 in this embodiment has on its first surface 60*a* facing the drive IC 65 electric wires that transmit various electrical signals supplied from the main board 50 via the FPC 51.

Specifically, the wiring board 60 has a substantially rectangular shape having a first side H1 and second sides H2 that intersect each other. The second sides H2 are longer than the first side H1. As indicated by shaded areas in FIG. 7, on the first surface 60*a* of the wiring board 60, first input terminals T1 to which the drive signals COM-A and COM-B and the constant voltage VBS are input and a second input terminal T2 to which the control signals Ctr are input are formed in a region that is located close to the first side H1 and that extends along the first side H1. That is, portions of the first surface 60*a* of the wiring board 60 which are occupied by the first input terminals T1 and the second input terminal T2 are in the region close to the first side H1. In this embodiment, two first input terminals T1 are formed on the first surface 60*a* corresponding to the two nozzle rows (see FIG. 4) that are the nozzle row Na and the nozzle row Nb. The two first input terminals T1 are formed at locations that are at both sides of the second input terminal T2 and that are near and along the first side H1.

Furthermore, on the first surface 60*a* of the wiring board 60, two first wires 71 electrically connected to the two first input terminals T1, respectively, and a second wire 72 electrically connected to the second input terminal T2 are formed along the second sides H2. The two first wires 71 are axially symmetrical about a center line 75 that is a straight line which extends through a center of the second input terminal T2 in a direction along the first side H1 and which extends along the second sides H2. Incidentally, in this embodiment, the first wires 71 correspond to joining portions of the first input terminals T1 to which the FPC 51 are electrically joined and the second input terminal T2 corresponds to a joining portion of the second wire 72 to which the FPC 51 is electrically joined. That is, the first input terminals T1 and the second input terminal T2 are formed in regions that are more to the first side H1 side than regions in which the first wires 71 are formed and a region in which the second wire 72 is formed and that are along the first side H1.

The second wire 72 has a short wire length that extends from the second input terminal T2 to a location that is a small length (e.g., about 1 to 2 mm) inward from a first side H1-side end of the drive IC 65. On the other hand, the first wires 71 are longer along the second sides H2 than the second wire 72. Each first wire 71 is provided with a bent portion 71K at a location that is farther from the first side H1 along the second sides H2 than the location of the second wire 72 is. The bent portion 71K of each first wire 71 is bent so as to become farther apart from the closer one of the second sides H2. These bent portions 71K will be described in detail later.

In this embodiment, each one of the first wires 71 includes three electric wires of the same wire width which are a wire 71*a* that transmits the drive signal COM-A, a wire 71*b* that transmits the drive signal COM-B, and a wire 71*c* that transmits the constant voltage VBS, in that order from the closer one of the second sides H2. On the other hand, the second wire 72 having a shorter wire length along the second sides H2 than the first wires 71 includes five electric wires that have a narrower wire width than the first wires 71 and that transmit the control signals Ctr.

Furthermore, on the first surface 60*a* of the wiring board 60 in this embodiment, third input terminals T3 to which a constant-potential signal having a constant electric potential is input are formed between the first input terminals T1 and the second input terminal T2. The third wires 73 electrically connected to the third input terminals T3 are formed between the first wires 71 and the second wire 72 and extend side by side with the first wires 71 and along (i.e., substantially in parallel with) the second sides H2. That is, the third wires 73 formed on the first surface 60*a* are in regions between wiring regions in which the first wires 71 are formed and a wiring region in which the second wire 72 is formed.

Similar to the first wires 71, the third wires 73 each have a bent portion 73K. Furthermore, the third wires 73 have an axially symmetric shape, that is, two third wires 73 are formed on the first surface 60*a* axially symmetrically, with the symmetry axis being the center line 75, similar to the first wires 71. Furthermore, as indicated by shaded areas in FIG. 7, the third input terminals T3 correspond to joining portions of the third wires 73 to which the FPC 51 is electrically joined.

In this embodiment, each of the third wires 73 includes four electric wires that are a wire 73*a* that transmits the voltage VH, a wire 73*b* that transmits the ground voltage GND, a wire 73*c* that also transmits the ground voltage GND, and a wire 73*d* that transmits the voltage VL, in that order from the closer one of the second sides H2. Furthermore, the wire width of each third wire 73 is narrower than that of the first wires 71 and wider than that of the second wire 72. Therefore, on the first surface 60*a* of the wiring board 60, the area of the region in which the third wires 73 are formed is smaller than the area of the region in which the first wires 71 are formed and is larger than the area of the region in which the second wire 72 is formed.

For example, along the first side H1, a wiring region 82 in which 2.5 second wires 72 are formed, a wiring region 83 in which four third wires 73 are formed, and a wiring region 81 in which three first wires 71 are formed exist in that order from the center line 75 toward each second side H2 along the first side H1. In this embodiment, in terms of the dimension along the first side H1, the wiring region 81 is the longest, followed by the wiring region 83 and then by the wiring region 82. That is, the wire widths of the first wires 71, the second wire 72, and the third wires 73 are set so that the wiring region 81 is the longest along the first side H1, followed by the wiring region 83 and then by the wiring region 82. Incidentally, as illustrated in FIG. 7, the length of the third wires 73 along the second sides H2 is equal to that of the first wires 71 in this embodiment; however, the length of the third wires 73 along the second sides H2 may be longer than that of the second wire 72 and shorter than that of the first wires 71.

Now, as for the electric wires formed on the wiring board 60, each of the three electric wires of each first wire 71 is provided with first connection terminals 76 that are electrical connected to the drive IC 65 and that are spaced by clearances from one another along the second sides H2. On another hand, each of the five electric wires of the second wire 72 has, at a location in the direction along the second sides H2, a second connection terminal 77 that is electrically connected to the drive IC 65. In this embodiment, the first connection terminals 76 and the second connection terminals 77 are formed as bumps provided on the active surface of the drive IC 65 that faces the wiring board 60 are connected to portions of the first wires 71 and portions of the second wire 72. Incidentally, the first connection terminals 76 and the second connection terminals 77 may also be formed as bumps provided on portions of the first wires 71 and the second wire 72 are connected to terminals provided on the active surface of the drive IC 65 which faces the wiring board 60.

Furthermore, in this embodiment, each of the four electric wires of each third wire 73 formed on the wiring board 60 is provided with third connection terminals 78 that are electrically connected to the drive IC 65 and that are spaced from one another by clearances along the second sides H2. These third connection terminals 78 are formed at the same locations along the second sides H2 as the first connection terminals 76.

In this embodiment, of the plurality of first connection terminals 76 formed on the wiring board 60 at intervals along the second sides H2, the first connection terminals 76 nearest to the first side H1 are at a distance L1 from the first side H1 along the second sides H2 that is longer than a distance L2 of the second connection terminals 77 from the first side H1 along the second sides H2. Furthermore, since the first input terminals T1 and the second input terminal T2 are formed along the first side H1, the length of the second wire 72 from the second input terminal T2 to the second connection terminals 77 on the wiring board 60 is shorter than the length of the first wires 71 from the first input terminals T1 to the first connection terminals 76. Due to this configuration, a region in the first surface 60*a* of the wiring board 60 which is farther apart from the first side H1 along the second sides H2 than the second connection terminals 77 are from the first side H1 can be used as a region in which to lay out the first wires 71 and the third wires 73.

Furthermore, in this embodiment, in the region in the first surface 60*a* of the wiring board 60 which is farther along the second sides H2 from the first side H1 than the second connection terminals 77 are, each of the first wires 71 is provided with the bent portion 71K bent so as to become farther apart from the closer one of the second sides H2. Similarly, the third wires 73 laid out along the first wires 71 are provided with bent portions 73K that are formed along the bent portions 71K so as to become farther apart from the second sides H2 and nearer to the center line 75. Specifically, each of the first wires 71 and the third wires 73 has, at a location apart from the first side H1 by a predetermined distance, a bend where the wire shifts away from the closer one of the second sides H2 without changing its wire width. The portion of each of the first wires 71 and the third wires 73 which extends from the bend in the direction away from the first side H1 along the second sides H2 forms the bent portion 71K or 73K.

Because the first wires 71 are provided with the bent portions 71K, the first surface 60*a* of the wiring board 60 has regions with no wires between the second sides H2 and the first wires 71. In this embodiment, the first output terminals 91 to which the drive voltage VT output from the drive IC 65 (from the bumps 69*a*) is transmitted are formed in the regions on the first surface 60*a* of the wiring board 60 which are between the second sides H2 and the bent portions 71K of the first wires 71. Note that the second output terminals 92 to which the constant voltage VBS output from the drive IC 65 (the bumps 69*b*) is transmitted are formed between the two third wires 73 and, more specifically, on the center line 75, on the first surface 60*a* of the wiring board 60.

Figure 8:
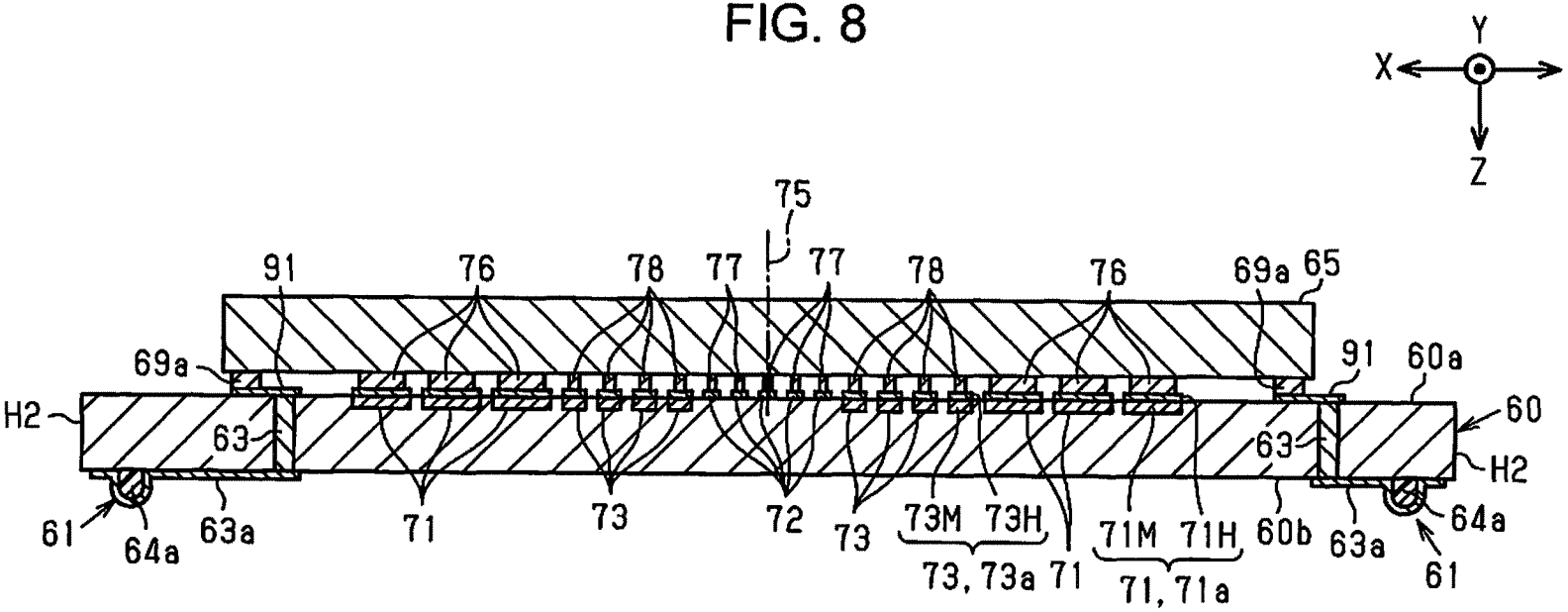
FIG. 8 is a sectional view taken along line VIII-VIII in FIG. 7, illustrating a state in which the wiring board and the drive IC are electrically interconnected.

Furthermore, as illustrated in FIG. 8, in this embodiment, each of the first wires 71 and the third wires 73 formed on the first surface 60*a* of the wiring board 60 is an embedded wire of which at least a portion is embedded in the wiring board 60. Specifically, each of the first wires 71 has an embedded portion 71M that is embedded in the wiring board 60 and made of a conductive material and a surface layer portion 71H that coats a first surface 60*a* side of the embedded portion 71M and that is made of a conductive material different from the conductive material of the embedded portion 71M. Similarly, each of the third wires 73 has an embedded portion 73M that is embedded in the wiring board 60 and made of a conductive material and a surface layer portion 73H that coats a first surface 60*a* side of the embedded portion 73M and that is made of a conductive material different from the conductive material of the embedded portion 73M. As a result, each of the first wires 71, being an embedded wire made up of the embedded portion 71M and the surface layer portion 71H, is provided as an electric wire whose wire thickness orthogonal to its wire width is increased and which is made of a combination of different conductive materials. Similarly, each of the third wires 73, being an embedded wire made up of the embedded portion 73M and the surface layer portion 73H, is provided as an electric wire whose wire thickness orthogonal to its wire width is increased and which is made of a combination of different conductive materials.

In this embodiment, the embedded wires are formed in the wiring board 60 as follows. First, recess portions for forming embedded portions 71M and 73M in the first surface 60*a* of the wiring board 60 are formed by a photolithography step and an etching step. Next, the recess portions are filled with a conductive material by using an electrolytic plating method or a conductive paste printing method. The conductive material covering the first surface 60*a* is then removed to form the embedded portions 71M and 73M whose surfaces are exposed. After that, surface layer portions 71H and 73H that coat the exposed first surface 60*a*-side surfaces of the embedded portions 71M and 73M and that are made of a conductive material different from the conductive material of the embedded portions 71M and 73M are formed by a photolithography step and an etching step. Thus, the embedded wires are formed.

Note that, in this embodiment, simultaneously with the formation of the embedded wires, the penetrating wires 63, the first conducting terminals 61, and the first output terminals 91 are formed in the wiring board 60. Likewise, although not illustrated in FIG. 8, the second conducting terminals 62 and the second output terminals 92 are formed simultaneously with the formation of the embedded wires (see FIG. 3).

For example, through holes for the penetrating wires 63 are formed simultaneously with the formation of the recess portions, and the penetrating wires 63 are formed simultaneously with the formation of the embedded portions 71M and 73M. After that, a resin film is formed on the second surface 60*b* of the wiring board 60 and then internal resin portions 64*a* and 64*b* are formed by a photolithography step and an etching step. Then, simultaneously with the formation of the surface layer portions 71H and 73H, the connecting wires 63*a* and the connecting wire 63*b* are formed together with the first output terminals 91 and the second output terminals 92. Through this formation process, the internal resin portions 64*a* and the internal resin portions 64*b*, and portions of the connecting wires 63*a* and the connecting wire 63*b* that cover the internal resin portions 64*a* and the internal resin portions 64*b*, respectively, form resin bumps each of which forms one of the first conducting terminals 61 or one of the second conducting terminals 62.

In this embodiment, it is preferable that the wiring board 60 be of a silicon single crystal substrate and the outermost surface of each electric wire surface (the surface layer portion 71H or 73H thereof) be made of gold (Au). However, this is not restrictive, that is, the outermost surface of each electric wire surface may be made of a different material (Ti, Al, Cr, Ni, Cu, etc.). Furthermore, the bumps connecting the drive IC 65 and the wiring board 60 do not necessarily need to be resin core bumps made up of a resin core and a conductive layer of Au or the like coating the surface of the resin core but may also be Au bumps, alloy bumps, ball bumps, plated bumps, printed bumps, etc.

Figure 9:
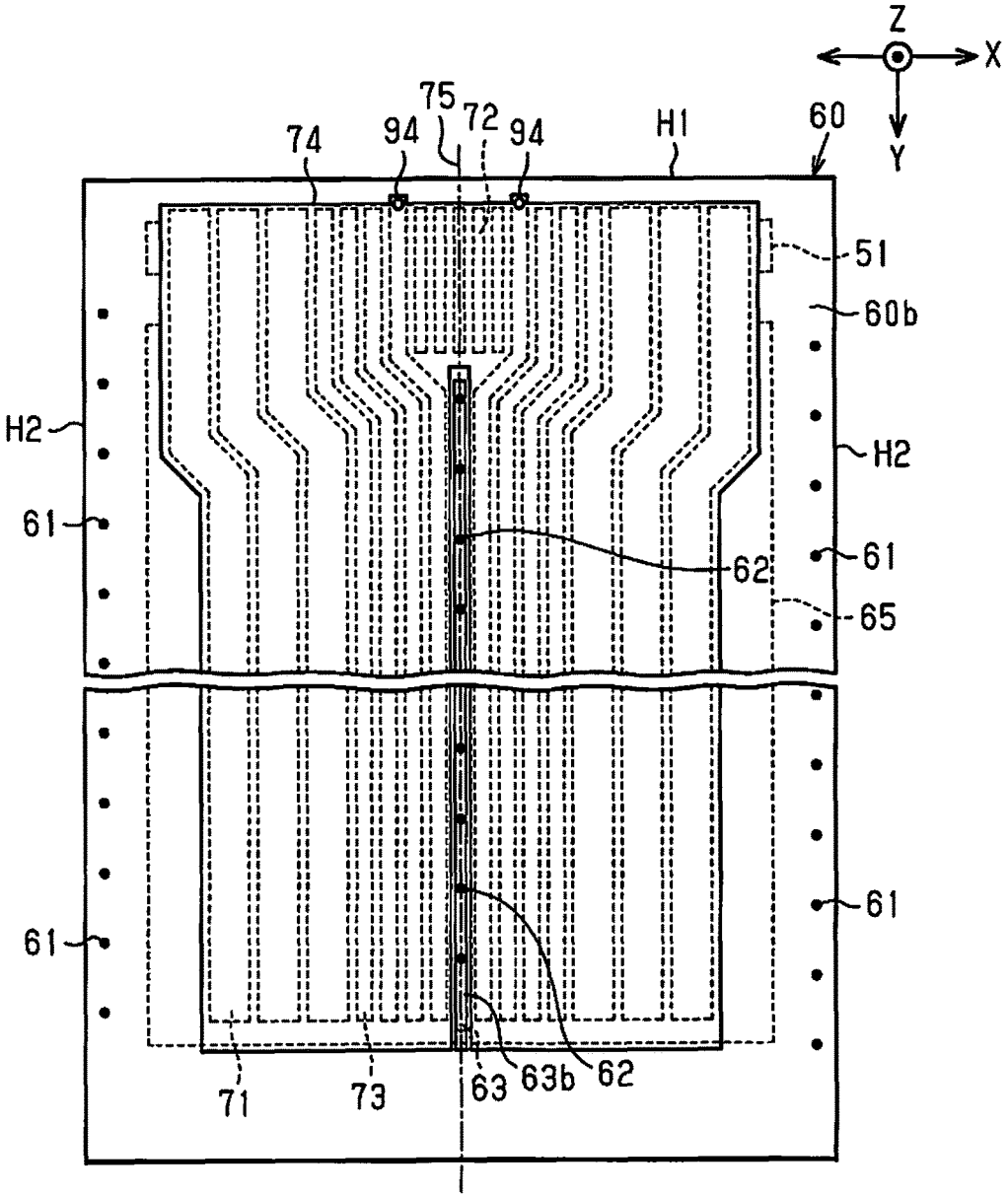
FIG. 9 is a plan view illustrating a wiring board whose second surface is provided with a constant-potential wire.

By the way, as illustrated in FIG. 9, in this embodiment, the second surface 60*b* of the wiring board 60 is provided with a fourth wire 74 electrically connected to the third wires 73 that transmit constant electric potentials. In this example, the fourth wire 74 is electrically connected to, of the third wires 73 formed on the first surface 60*a*, wires 73*d* through which the voltage VL is transmitted, via penetrating wires 94 formed through the thickness of the wiring board 60.

Furthermore, in this embodiment, the area of the fourth wire 74 formed on the second surface 60*b* is larger than the area of the regions on the first surface 60*a* in which the first wires 71, the second wire 72, and the third wires 73 are formed. That is, the fourth wire 74 is a substantially rectangular solid electrode within whose wiring region all the electric wires of the first wires 71, the second wire 72, and the third wires 73 are located, in a see-through view of the wiring board 60 taken from the gravity direction Z, which is a direction of a normal line to the second surface 60*b*.

Incidentally, the fourth wire 74 has an axially symmetric shape with its symmetry axis being the center line 75 and portions of the fourth wire 74 along the center line 75 are provided with a slit. In this slit there are disposed the connecting wire 63*b* and the second conducting terminals 62 to which the constant voltage VBS is transmitted via the penetrating wires 63. Furthermore, on the second surface 60*b*, although not illustrated in FIG. 9, the connecting wires 63*a* electrically connecting the first conducting terminals 61 and the first output terminals 91 are formed between the fourth wire 74 and the second sides H2.

Advantageous effects of the embodiment will be described with reference to FIGS. 7 to 9.

As illustrated in FIG. 7, on the wiring board 60, the wiring region 82 of the second wire 72 through which digital signals are transmitted and the wiring regions 81 of the first wires 71 through which analog signals are transmitted are separated by the wiring regions 83 of the third wires 73 through which the constant electric potentials are transmitted. In other words, the wiring regions 83 are disposed (intervene) between the wiring region 82 and the wiring regions 81. Therefore, noise interference between the wiring region 82 and the wiring regions 81 can be inhibited by the wiring regions 83.

Furthermore, the wire width of the first wires 71 is greater than the wire widths of the second wire 72 and the third wires 73. Due to this, the regions occupied by the first wires 71 are comparatively large, so that the wire impedance of the first wires 71 is accordingly lower. Furthermore, because the first wires 71 and the drive IC 65 are electrically interconnected at a plurality of sites by the first connection terminals 76, the increase in impedance attributed to the connection can be inhibited.

Furthermore, the two-dimensional shape of the wiring board 60 is a substantially rectangular shape whose second sides H2 is longer than the first side H1. The first output terminals 91 are aligned along the second sides that are the long sides. Due to this, the connecting wires 63*a* that transmit from the first output terminals 91 to the first conducting terminals 61 the drive voltage VT to be supplied to the piezoelectric elements PZ can be made short in wire length, so that increase in the impedance that occurs in the wires can be inhibited.

As illustrated in FIG. 8, the first wires 71 and the third wires 73 are at least partially embedded wires, so that increase in the impedance that occurs in the individual electric wires can be inhibited. Therefore, the impedances of the first wires 71 and the third wires 73 can be inhibited according to the lengths of the embedded wires formed for the first wires 71 and the third wires 73.

As illustrated in FIG. 9, on the second surface 60*b* of the wiring board 60, the fourth wire 74 is provided as a solid electrode with a constant electric potential that is the voltage VL, so that the wiring regions of the first wires 71 formed on the first surface 60*a* and the wiring region of the second wire 72 formed on the first surface 60*a* are substantially entirely given a constant electric potential. Therefore, the solid electrode with the stable electric potential reduces the impedances of the first wires 71 and the third wires 73. Moreover, because the fourth wire 74 forms a solid electrode that supports, from the opposite side, (backs up) all the input terminals (joining portions for the FPC 51) on the wiring board 60 and the connection terminals thereon to the drive IC 65, the input terminals and the connection terminals can be structurally reinforced.

This embodiment achieves advantageous effects as follows.

(1) The area ratio of the first wires 71 that transmit the drive signals COM-A and COM-B to the constant voltage VBS to the first surface 60*a* of the wiring board 60 can be increased in a region that is farther from the first side H1 along the second sides H2 than the second connection terminals 77 are. This reduces the impedance of the first wires 71 while inhibiting increase in the area of the wiring board 60. Therefore, in the liquid discharge head 40, it is possible to inhibit fluctuations in an ink discharge characteristic attributed to the impedance of the electric wire while restraining an increase in the size of the liquid discharge head 40.

(2) Because, on the wiring board 60, the wire length of the electric wires through which the control signals Ctr are transmitted is made shorter than the wire length of the electric wires through which the drive signals COM-A and COM-B are transmitted, the influence of the control signals Ctr on the drive signals COM-A and COM-B is restrained. Furthermore, due to the reduced length of the second wire 72, the area ratio of the first wires 71 to the first surface 60*a* can be increased. Furthermore, the voltage reduction of the control signals Ctr transmitted through the second wire 72 and the heat production from the second wire 72 due to the control signals Ctr transmitted therethrough can be restrained.

(3) Since the portions of the first surface 60*a* of the wiring board 60 that are occupied by the first input terminals T1 and the second input terminal T2 can be provided in a region near the first side H1, a region in the first surface 60*a* of the wiring board 60 which is apart from the first side H1 along the second sides H2 (i.e., in the direction along the second sides H2) can be used as a wiring region for the first wires 71 and the second wire 72.

(4) Because of the bent portions 71K of the first wires 71, regions in the first surface 60*a* of the wiring board 60 which are near the second sides H2 can be used as wiring regions for the first output terminals 91 of the drive signals COM-A and COM-B for the piezoelectric elements PZ.

(5) In the case where the piezoelectric element-formed substrate 45 is provided with a plurality of piezoelectric elements PZ, a plurality of first output terminals 91 for outputting the drive signals COM-A and COM-B to the individual piezoelectric elements PZ can be formed on the wiring board 60, along the second sides H2 that are longer than the first side H1.

(6) Since the first wires 71 and the drive IC 65 are electrically interconnected at a plurality of locations, the increase in impedance attributed to the connection can be inhibited, so that the fluctuations in the ink discharge characteristic caused by distortion of the drive signals COM-A and COM-B can be inhibited.

(7) Since the first wires 71 are at least partially embedded in the wiring board 60, the cross-sectional area of the first wires 71 can be increased without increasing the wire width of the first wires 71. This reduces the resistance (impedance) of the first wires 71 and can inhibit the fluctuations in the ink discharge characteristic attributed to the impedance of the first wires 71.

(8) As for the embedded wiring of the first wires 71, since the surface layer portion 71H of each embedded wire covers the embedded portion 71M thereof, the electrical characteristic of the first wires 71 can be inhibited from changing with changes in the environment. Furthermore, a break of the first wires 71 due to migration or the like can be inhibited. Therefore, a highly reliable liquid discharge head 40 can be provided.

(9) Since the constant-potential signals (voltages VH and VL and the ground voltage GND) transmitted through the third wires 73 exist between the drive signals COM-A and COM-B transmitted through the first wires 71 and the control signals Ctr transmitted through the second wire 72, the distortion of signals caused by mutual interference between the drive signals COM-A and COM-B and the control signals Ctr can be inhibited by the constant electric potentials.

(10) With regard to the first wires 71, the second wire 72, and the third wires 73, the differences in impedance between the wires can be relatively adjusted by the area of the wiring region for each wire. Therefore, the impedances of the drive signals COM-A and COM-B, the constant-potential signals, and the control signals Ctr can be optimized. Therefore, the fluctuations in electric potential between the wires due to the impedances of the electric wires are inhibited, so that differences in the ink discharge characteristic between the piezoelectric elements PZ can be reduced.

(11) Since the third wires 73 are at least partially embedded in the wiring board 60, the cross-sectional area of the third wires 73 can be increased without increasing the wire width of the third wires 73. Therefore, in the liquid discharge head 40, the resistance (impedance) of the third wires 73 can be reduced and the fluctuations in the ink discharge characteristic due to the impedance of the third wires 73 can be inhibited.

(12) As for the embedding wiring of the third wires 73, the surface layer portion 73H of each embedded wire covers the embedded portion 73M thereof, the electrical characteristic of the third wires 73 can be inhibited from changing with changes in the environment. Furthermore, a break of the third wires 73 due to migration or the like can be inhibited. Therefore, a highly reliable liquid discharge head 40 can be provided.

(13) In the wiring board 60, the solid electrode (solid pattern) with a stable electric potential is formed on the second surface 60*b* opposite to the first surface 60*a*, corresponding to the entire wiring region of the first wires 71, the second wire 72, and the third wires 73 formed on the first surface 60*a*. Therefore, fluctuations in the liquid discharge characteristic of the liquid discharge head 40 can be inhibited by, for example, inhibiting the distortion of the drive signals COM-A and COM-B caused by external noise.

Furthermore, since the solid electrode increases the strength of the wiring board 60, the productivity (yield) in packaging the drive IC 65 and the FPC 51 can be improved. Therefore, the electric characteristic thereof become stable, so that a highly reliable liquid discharge head 40 (head module 23) can be provided.

The embodiments may be changed as in the following modifications. The embodiments and the modifications may be combined in any manner.

In the embodiments, the fourth wire 74 formed on the second surface 60*b* of the wiring board 60 does not necessarily need to be electrically connected to the voltage VL of the third wires 73. For example, the fourth wire 74 may instead be connected to the voltage VH or the ground voltage GND. Furthermore, the fourth wire 74 does not necessarily need to be electrically connected to the third wires 73. For example, the fourth wire 74 may instead be connected to the constant voltage VBS of the first wires 71. In short, it suffices that a constant electric potential is connected to the fourth wire 74. The constant electric potential connected to the fourth wire 74 may be a voltage that contains a degree of error that does not affect the discharge of ink. Incidentally, in the case where the constant voltage VBS is connected to the fourth wire 74, the connecting wire 63*b* illustrated in FIG. 9 can be integrated with the fourth wire 74.

In the embodiment, the area of the region on the second surface 60*b* of the wiring board 60 in which the fourth wire 74 is formed does not necessarily need to be larger than the area of the region on the first surface 60*a* in which the first wires 71, the second wire 72, and the third wires 73 are formed. Alternatively, on the second surface 60*b* of the wiring board 60, the fourth wire 74 does not need to be formed.

In the embodiment, the third wires 73 does not necessarily need to have the embedded portions 73M embedded in the wiring board 60 and the surface layer portions 73H covering the first surface 60*a* side of each embedded portion 73M. For example, the third wires 73 may be made up of a single conductive material and partially embedded in the wiring board 60.

In the embodiment, in the first surface 60*a* of the wiring board 60, the third wires 73 do not necessarily need to be embedded wires which is embedded in the wiring board 60 and whose first surface 60*a*-side surfaces are exposed. That is, the third wires 73 may instead by electric wires formed on the first surface 60*a*.

In the embodiment, on the first surface 60*a* of the wiring board 60, the area of the region in which the third wires 73 are formed does not necessarily need to be smaller than the area of the region in which the first wires 71 are formed and larger than the area or the region in which the second wire 72 is formed. For example, in the case where the third wires 73 include many electric wires, the area of the region in which the third wires 73 are formed may be larger than the area of the region in which the first wires 71 are formed.

In the embodiment, the first surface 60*a* of the wiring board 60 does not necessarily need to be provided with the third input terminals T3 to which the constant-potential signals having constant electric potentials are input and the third wires 73 that are electrically connected to the third input terminals T3. For example, in the case where the constant-potential signals are input directly to the drive IC 65 without being transmitted via the wiring board 60, the wiring board 60 does not need to be provided with the third input terminals T3 and the third wires 73.

In this case, it is preferable that the area of the region on the second surface 60*b* of the wiring board 60 in which the fourth wire 74 formed on the second surface 60*b* is provided be larger than the total area of the region on the first surface 60*a* in which the first wires 71 are provided and the region on the first surface 60*a* in which the second wire 72 is provided. Furthermore, it is preferable that, when the wiring board 60 is viewed in a see-through manner from the gravity direction Z, which is a direction of a normal line to the second surface 60*b*, all the electric wires of the first wires 71 and the second wire 72 be located within the wiring region of the fourth wire 74. Furthermore, the fourth wire 74 be connected to the constant voltage VBS, which is a constant electric potential.

In the embodiment, each of the first wires 71 does not necessarily need to have the embedded portion 71M embedded in the wiring board 60 and the surface layer portion 71H covering the first surface 60*a* side of the embedded portion 71M. For example, each first wire 71 may be made up of a single conductive material and partially embedded in the wiring board 60.

In the embodiment, in the first surface 60*a* of the wiring board 60, the first wires 71 do not necessarily need to be embedded wires which are embedded in the wiring board 60 and whose first surface 60*a*-side surfaces are exposed. Specifically, the first wires 71 may be electric wires formed on the first surface 60*a*.

In the embodiment, on the wiring board 60, the first wires 71 do not necessarily need to be provided with the plurality of first connection terminals 76 spaced from each other along the second sides H2. For example, each first wire 71 may be provided with one first connection terminal 76.

In the embodiment, as for the wiring board 60, the length of the second sides H2 does not necessarily need to be greater than the length of the first side H1. For example, the wiring board 60 may have a square shape with the first side H1 and the second sides H2 being equal in length or may also have a rectangular shape with the second sides H2 being shorter than the first side H1.

In the embodiment, the first wires 71 on the wiring board 60 do not necessarily need to have, at locations farther from the first side H1 in the direction along the second sides H2 than the second connection terminals 77 formed on the second wire 72 are from the first side H1, the bent portions 71K that are bent or shifted away from the second sides H2. For example, the first wires 71 may linearly extend, without a bend, along the second sides H2 from the first input terminals T1. In this case, however, it is preferable that the first wires 71 be spaced from the second sides H2 so that the first output terminals 91 can be formed in spaces from the second sides H2.

In the embodiment, on the wiring board 60, the first input terminals T1 and the second input terminal T2 do not necessarily need to be formed along the first side H1. For example, the first input terminals T1 and the second input terminal T2 may be formed along the second sides H2.

In the embodiment, on the wiring board 60, the distance L2 on the second wire 72 from the second input terminal T2 to the second connection terminals 77 does not necessarily need to be shorter than the distance L1 on the first wires 71 from the first input terminals T1 to the first connection terminals 76. For example, the distance L2 and the distance L1 may be equal in length or the distance L2 may be longer than the distance L1.

In the embodiment, as for the first wires 71, it is not altogether necessary that the wire 71*a* transmit the drive signal COM-A, the wire 71*b* transmit the drive signal COM-B, and the wire 71*c* transmit the constant voltage VBS. For example, it is permissible that the wire 71*a* transmit the drive signal COM-B and the wire 71*b* transmit the drive signal COM-A. In short, it is preferable that the drive signal COM-A, the drive signal COM-B, and the constant voltage VBS that are transmitted through the first wires 71 be transmitted in such a manner that the signal distortion of these signals by other electrical signals is minimized.

Furthermore, the first wires 71 may be two electric wires that transmit the drive signal COM-A and the drive signal COM-B. In this case, the electric wire that transmits the constant voltage VBS may be of the third wires 73 instead of the first wires 71.

In the embodiment, as for the third wires 73, it is not altogether necessary that the wire 73*a* transmit the voltage VH, the wires 73*b* and 73*c* transmit the ground voltage GND, and the wire 73*d* transmit the voltage VL. For example, it is permissible that the wire 73*a* transmit the voltage VL and the wire 73*d* transmit the voltage VH. In short, it is preferable that the voltage VH, the voltage VL, and the ground voltage GND that are transmitted through the third wires 73 be transmitted in such a manner that the signal distortion of these signals by other electrical signals is minimized.

Furthermore, the third wires 73 may be three electric wires instead of the four wires. In this case, the three electric wires transmit the voltage VH, the voltage VL, and the ground voltage GND, respectively.

In the embodiment, the wiring board 60 and the piezoelectric element-formed substrate 45 do not necessarily need to be electrically interconnected by the resin bumps of the second conducting terminals 62 and the first conducting terminals 61. For example, the first output terminals 91 of the wiring board 60 and the first electrodes 43 of the piezoelectric elements PZ may be electrically interconnected by wire bonding.

In the embodiment, the ink may be supplied not from the ink cartridge 22 but from, for example, an ink tank (not illustrated) provided on the outward side of the frame 12.

The liquid discharge apparatus 11 of the embodiment may be, for example, a large-format printer that performs printing (recording) on a sheet P of paper that is an example of an elongated medium. In this case, the liquid discharge apparatus 11 may be constructed so that the sheet P is unrolled from a rolled state and transported onto the medium support table 13.

In the embodiment, the liquid discharge apparatus 11 may also be a so-called line printer that, instead of having the head unit 20 on the carriage 21, has a stationary head unit 20 that has an increased length that corresponds to the entire width of the sheet P. In this case, the head unit 20 is provided with a plurality of head modules 23 and each head module 23 is provided with a plurality of nozzles N arranged so as to cover the entire width of the sheet P in the scanning direction X.

In the embodiment, the liquid used for printing may also be a fluid other than ink (such as liquids, liquid materials in which functional material particles are dispersed or mixed, fluid bodies such as gel, solids that can be moved and discharged as fluid). For example, the liquid discharge apparatus 11 may be constructed to perform printing (recording) by discharging a liquid material that contains a material, such as a color material (pixel material) or an electrode material for use for manufacturing a liquid crystal display, an EL (electroluminescence) display, a surface emitting display, etc., in the form of dispersion or solution.

In the embodiment, the liquid discharge apparatus 11 may be a fluid body discharge apparatus that discharges a fluid body such as gel (e.g., a physical gel) or a powder and granular material discharge apparatus (e.g., a toner jet type recording apparatus) that discharges a solid exemplified by a powder (powder and granular material) such as a toner. Incidentally, the "fluid" used in this specification does not include a liquid that is made up only of gas but includes, for example, liquids (including inorganic solvents, organic solvents, solutions, liquid resins, liquid metals (metal melts), etc.), liquid materials, fluid bodies, powder and granular materials (including granules and powders), etc.

In the embodiment, the medium is not limited to the sheet P of paper but may also be a plastic film or a thin plate member and may also be a cloth for use in textile printing apparatuses.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge head comprising:

a piezoelectric element;

a piezoelectric element-formed substrate in which the piezoelectric element is formed;

a drive IC configured and arranged to output a drive signal to the piezoelectric element based on a control signal; and a wiring board which has a first side and a second side intersecting each other, the wiring board further having two surfaces including a first surface and a second surface with the first surface facing the drive IC and the second surface facing the piezoelectric element-formed substrate, the liquid discharge head receiving the drive signal to drive the piezoelectric element and the control signal to control output of the drive signal to the piezoelectric element and discharging a liquid in response to the drive signal output to the piezoelectric element to drive the piezoelectric element, the wiring board including on the first surface a first input terminal to which the drive signal is input and a second input terminal to which the control signal is input, and a first wire electrically connected to the first input terminal and a second wire electrically connected to the second input terminal, the first wire and the second wire extending along the second side, the first wire having a first connection terminal electrically connected to the drive IC, the second wire having a second connection terminal electrically connected to the drive IC, and a distance along the second side from the first side to the first connection terminal being longer than a distance along the second side from the first side to the second connection terminal, wherein on the wiring board, the first wire has a bent portion at a location that is farther from the first side along the second side than the second connection terminal formed on the second wire, the bent portion being bent so as to be farther apart from the second side, and an output terminal of the drive signal output from the drive IC is formed between the bent portion and the second side.

2. The liquid discharge head according to claim 1, wherein on the wiring board, the first input terminal and the second input terminal are closer to the first side than a region in which the first wire is formed and a region in which the second wire is formed, respectively, and the first input terminal and the second input terminal are formed along the first side.

3. The liquid discharge head according to claim 1, wherein on the wiring board, a length of the second wire from the second input terminal to the second connection terminal is shorter than a length of the first wire from the first input terminal to the first connection terminal.

4. The liquid discharge head according to claim 1, wherein the second side of the wiring board is longer than the first side of the wiring board.

5. The liquid discharge head according to claim 1, wherein on the wiring board, the first wire has a plurality of the first connection terminals spaced apart from each other along the second side.

6. The liquid discharge head according to claim 1, wherein on the first surface of the wiring board, at least a portion of the first wire is an embedded wire that is embedded in the wiring board.

7. The liquid discharge head according to claim 6, wherein the embedded wire has an embedded portion made of a conductive material and embedded in the wiring board, and a surface layer portion that covers a first surface side of the embedded portion and that is made of a conductive material different from the conductive material of the embedded portion.

8. The liquid discharge head according to claim 1, wherein the wiring board includes on the first surface a third input terminal to which a constant-potential signal that is a constant electric potential is input and a third wire electrically connected to the third input terminal, and the third wire is formed in a region on the first surface between a region in which the first wire is formed and a region in which the second wire is formed.

9. The liquid discharge head according to claim 8, wherein on the first surface of the wiring board, an area of the region in which the third wire is formed is smaller than an area of the region in which the first wire is formed and larger than an area of the region in which the second wire is formed.

10. The liquid discharge head according to claim 8, wherein on the first surface of the wiring board, at a least portion of the third wire is an embedded wire that is embedded in the wiring board.

11. The liquid discharge head according to claim 10, wherein the embedded wire has an embedded portion made of a conductive material and embedded in the wiring board, and a surface layer portion that covers a first surface side of the embedded portion and that is made of a conductive material different from the conductive material of the embedded portion.

12. The liquid discharge head according to claim 8, wherein the wiring board includes on the second surface a fourth wire electrically connected to the constant electric potential, and an area of a region in which the fourth wire is formed on the second surface is larger than an area of the regions in which the first wire, the second wire, and the third wire are formed on the first surface.

13. A liquid discharge apparatus comprising:

a liquid discharge head including a piezoelectric element, the liquid discharge head receiving a drive signal to drive the piezoelectric element and a control signal to control output of the drive signal to the piezoelectric element, and discharging a liquid in response to the drive signal output to the piezoelectric element to drive the piezoelectric element; and a signal supply unit that supplies the drive signal and the control signal to the liquid discharge head, the liquid discharge head further including a piezoelectric element-formed substrate in which the piezoelectric element is formed, a drive IC configured and arranged to output the drive signal to the piezoelectric element based on the control signal, and a wiring board which has a first side and a second side intersecting each other, the wiring board further having two surfaces including a first surface and a second surface with the first surface facing the drive IC and the second surface facing the piezoelectric element-formed substrate, the wiring board including on the first surface a first input terminal to which the drive signal supplied from the signal supply unit is input and a second input terminal to which the control signal supplied from the signal supply unit is input, and a first wire electrically connected to the first input terminal and a second wire electrically connected to the second input terminal, the first wire and the second wire extending along the second side, the first wire having a first connection terminal electrically connected to the drive IC, and the second wire having a second connection terminal electrically connected to the drive IC, and a distance along the second side from the first side to the first connection terminal being longer than a distance along the second side from the first side to the second connection terminal, wherein on the wiring board, the first wire has a bent portion at a location that is farther from the first side along the second side than the second connection terminal formed on the second wire, the bent portion being bent so as to be farther apart from the second side, and an output terminal of the drive signal output from the drive IC is formed between the bent portion and the second side.

* * * * *